US008578858B2

(12) United States Patent
Drogo et al.

(10) Patent No.: US 8,578,858 B2
(45) Date of Patent: Nov. 12, 2013

(54) TRANSPORT INSTALLATION WITH AN AERIAL CABLE PROVIDED WITH A MAINTENANCE VEHICLE

(75) Inventors: Jean Philippe Drogo, Saint Joseph de Riviere (FR); Philippe Martin, Voreppe (FR); Franckie Tamisier, Saint-Nazaire-les-Eymes (FR)

(73) Assignee: Pomagalski, Voreppe (FR)

( * ) Notice: Subject to any disclaimer, the term of this patent is extended or adjusted under 35 U.S.C. 154(b) by 0 days.

(21) Appl. No.: 13/422,551

(22) Filed: Mar. 16, 2012

(65) Prior Publication Data

US 2012/0240812 A1 Sep. 27, 2012

(30) Foreign Application Priority Data

Mar. 23, 2011 (FR) ..... 11 00875

(51) Int. Cl.
*B61B 7/00* (2006.01)

(52) U.S. Cl.
USPC ..... 104/112; 182/14

(58) Field of Classification Search
USPC ..... 104/112, 113, 114, 115, 116, 117, 123, 104/124, 125, 173.1; 105/148, 149.1, 105/149.2; 14/18; 182/36, 150
See application file for complete search history.

(56) References Cited

U.S. PATENT DOCUMENTS

| | | | | |
|---|---|---|---|---|
| 3,237,718 | A * | 3/1966 | Pearson | 182/36 |
| 3,702,124 | A * | 11/1972 | Highland | 182/14 |
| 3,710,726 | A * | 1/1973 | Buchholz et al. | 104/112 |
| 3,858,520 | A * | 1/1975 | Patin | 104/89 |
| 3,945,462 | A * | 3/1976 | Griswold | 182/150 |
| 4,069,765 | A * | 1/1978 | Muller | 104/123 |
| 4,163,480 | A * | 8/1979 | Highland | 182/14 |
| 4,234,055 | A * | 11/1980 | Beeche | 182/142 |
| 4,253,548 | A * | 3/1981 | Beeche | 182/142 |
| D274,230 | S * | 6/1984 | Kelly | D12/37 |
| D274,320 | S * | 6/1984 | Kelly | D12/37 |
| 4,478,312 | A * | 10/1984 | Kurtgis | 182/142 |
| 4,641,587 | A * | 2/1987 | Dalliard | 105/3 |
| 4,705,140 | A * | 11/1987 | Dudley et al. | 182/3 |
| 4,882,998 | A * | 11/1989 | Lipp | 104/112 |
| 5,570,638 | A * | 11/1996 | Egli et al. | 104/173.1 |
| 6,189,455 | B1 * | 2/2001 | Thompson | 104/112 |
| 6,817,444 | B1 * | 11/2004 | Shinas | 182/150 |
| 2001/0037914 | A1 * | 11/2001 | Preusser et al. | 182/150 |
| 2003/0000414 | A1 * | 1/2003 | Sherman et al. | 104/112 |
| 2006/0131107 | A1 * | 6/2006 | Duguay | 182/150 |
| 2008/0178760 | A1 * | 7/2008 | Frangos et al. | 104/112 |
| 2008/0313825 | A1 * | 12/2008 | Murakoshi et al. | 14/19 |
| 2009/0050012 | A1 * | 2/2009 | Coudurier et al. | 105/149 |
| 2012/0240812 | A1 * | 9/2012 | Drogo et al. | 104/112 |

FOREIGN PATENT DOCUMENTS

| | | |
|---|---|---|
| DE | 36 41 778 C1 | 9/1987 |
| EP | 2 028 074 A1 | 2/2009 |

* cited by examiner

*Primary Examiner* — Jason C Smith
(74) *Attorney, Agent, or Firm* — Oliff & Berridge, PLC

(57) ABSTRACT

The transport installation with an aerial cable (2) for moving along a path, comprises a maintenance vehicle (1) provided with a gondola (4) mounted on a suspending rod (5) connected to the cable (2) by means of a fastener (9). The maintenance vehicle (1) moreover comprises a gangway (6) mounted on the suspending rod (5). A guiding rod (11) is fixed to the gangway (6) at one of its ends, and is connected to the cable (2) at its opposite end. The gangway (6) has a structure extending in the direction of displacement of the maintenance vehicle (1), and is pivotingly mounted on the suspending rod (5) so as to form an articulated bascule.

7 Claims, 7 Drawing Sheets

TRANSPORT INSTALLATION WITH AN AERIAL CABLE PROVIDED WITH A MAINTENANCE VEHICLE

TECHNICAL FIELD OF THE INVENTION

The invention relates to a transport installation with an aerial cable for moving along a path, the installation comprising a maintenance vehicle provided with:

a gondola mounted on a suspending rod connected to the cable by means of a fastener, a gangway mounted on the suspending rod.

STATE OF THE ART

A transport installation with an aerial cable conventionally includes a plurality of transport vehicles suspended to at least one main aerial cable which can be an hauling cable, a suspending cable or a suspending-hauling cable. The vehicles generally move along two paths, i.e. a forward path and a backward path. Such an installation can consist of a conventional gondola lift in which all the transport vehicles move along the same closed loop trajectory, or aerial tramway, or even by an installation of the type 'backwards and forwards', or of the type 'backwards or forwards'.

Conventionally, the aerial cable enables the vehicles to run from a station of departure to a station of arrival. Between these stations, the cable is kept at a distance from the ground by means of pylons which in particular enable to adapt the slope of the cable to the landscape the installation is running across.

Maintenance operations can be necessary at the rollers of these pylons. Consequently, there is a need to reach the top of these pylons. For that, the pylons are in general provided with a ladder leading to a gangway at the top of the pylons, and arranged to give access to the rollers.

A maintenance operation using a ladder is tiresome, and some pylons are not easy of approach.

To solve the problems of access to pylons, specific maintenance vehicles have been developed which are able to move though coupling with the mobile cable.

FIG. 1 illustrates such a maintenance vehicle 1 connected to a cable 2 at a pylon 3. The maintenance vehicle I comprises a gondola 4, and a suspending rod 5 mounted on the one hand to the gondola 4 and on the other hand to the cable 2 through a fastener 9. A gangway 6 is fixed to the suspending rod 5. Thus, between two pylons, the operator in charge of maintenance is protected in the gondola 4. When the maintenance vehicle 1 arrives to a pylon 3, said vehicle 1 is stopped, the operator can then go up onto the gangway 6, for example by using a ladder 7. The gangway 6 enables him to access to the mechanical parts of the pylon 3, as for example the pylon rollers 8 which support the cable 2.

The pylons often comprise, as illustrated in FIG. 1, a plurality of rollers 8, and the gangway 6 of the maintenance vehicle 1 does not enable to make all these rollers accessible. Consequently, to check all the rollers 8 of the same pylon 3, it is necessary to move the maintenance vehicle several times.

OBJECT OF THE INVENTION

The object of the invention consists in preferably carrying out an installation provided with a vehicle facilitating the maintenance operations for the installation at the pylons.

This objective is reached in that the maintenance vehicle comprises a guiding rod fixed to the gangway at one of its ends, and connected to the cable at its opposite end, and in that the gangway has a structure extending in the direction of displacement of the maintenance vehicle, and is pivotingly mounted to the suspending rod so as to form an articulated bascule.

According to a development, the gangway comprises steps arranged to remain horizontal whatever the pivoting angle of the gangway relative to the horizontal.

According to an embodiment, the gangway comprises two elongated frames extending in the direction of displacement of the maintenance vehicle, the elongated frames being pivotingly mounted on the suspending rod respectively according to two parallel pivoting axes shifted along the suspending rod, said frames being arranged to form a deformable parallelogram according to the pivoting angle of the gangway relative to the suspending rod.

According to an implementation of the embodiment, the gangway comprises spacers, each of them including a first end pivotingly mounted on two opposite longitudinal struts of one of the frames and a second end pivotingly mounted on two opposite longitudinal struts of the other frame.

According to an improvement, the spacers comprise two end spacers, each of them being arranged at a longitudinal end of the gangway and intermediate spacers, each of them being provided with a plate for forming a step, the guiding rod being fixed to one of the end spacers.

According to a particular implementation of the installation, the suspending rod comprises a main rod extending through both frames, two fasteners being fixed on both sides of the main rod, each fastener cooperating, by means of associated pivot connections, with a longitudinal strut of each frame.

According to an improvement, the gangway is provided with a railing able to be in an outspread state forming a guardrail, and in a storage state in which the railing is retracted in the direction of a platform of the gangway.

BRIEF DESCRIPTION OF THE DRAWINGS

Other advantages and features will more clearly arise from the following description of particular embodiments of the invention given as non-limitative examples and represented in the annexed drawings, in which.

DESCRIPTION OF PREFERRED EMBODIMENTS

Figure 1:
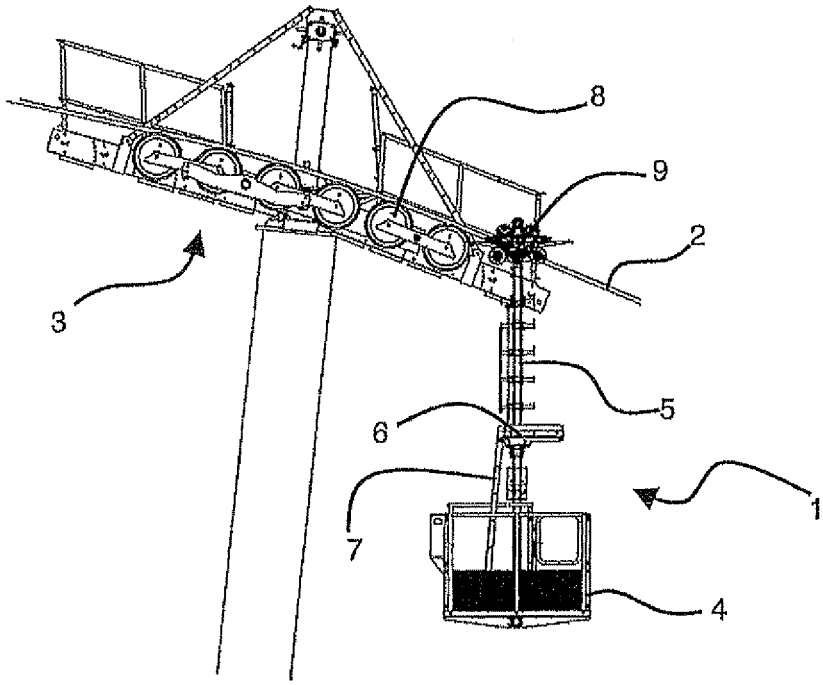
Figure 1 (Prior Art)
FIG. 1 represents an installation according to the prior art.

The installation, described hereafter, defers from the prior art in that it enables to increase the workspace for a maintenance operator at the gangway.

In FIGS. 2 to 6, the transport installation with an aerial cable 2, preferably including a hauling cable for moving along a path, preferably comprises a maintenance vehicle 1 provided with a gondola 4 mounted on a suspending rod 5 connected to the cable 2 preferably by means of a fastener 9. The fastener 9 is preferably fixed or disengageable relative to the cable 2.

The gondola 4 is intended to carry in a protected way one or more maintenance operators during the displacement of the maintenance vehicle 1. For that, the gondola 4 preferably comprises a guardrail 10.

Figure 6:
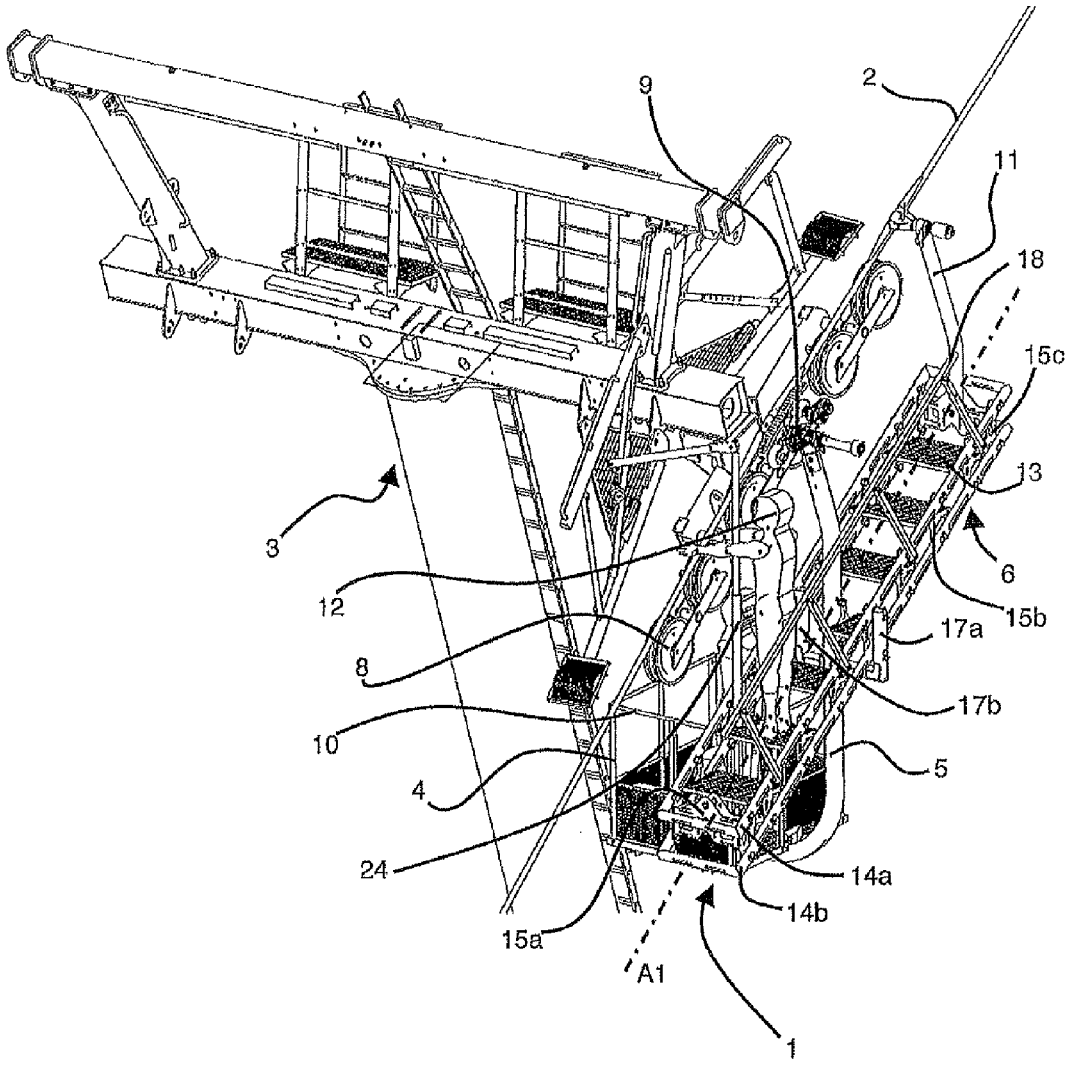
FIG. 6 illustrates the maintenance vehicle in the position of maintenance at a pylon of the installation.

The maintenance vehicle 1 moreover comprises a gangway 6 mounted on the suspending rod 5. This gangway 6 has a structure extending in the direction of displacement of the maintenance vehicle 1. In other words, the gangway 6 is elongated in the direction of displacement of the maintenance vehicle 1. This elongated shape allows the maintenance operator inter alia to have a larger workspace compared to the prior art and to access to several rollers 8, or even all of them, of a pylon 3 without moving the maintenance vehicle 1 when it is stopped at a pylon 3 (FIG. 6).

The elongated shape of the workspace involves on the one hand a risk of contact between the gangway 6 and the cables 2 in particular at the time of the passage by a pylon 3 which can change the slope of the cable 2 according to the evolution of the landscape. In addition, in order to work comfortably at a pylon 3, it is preferable that the gangway should always be at a constant height relative to the rollers 8 during the displacement of the operator along the gangway 6. When the gangway 6 is horizontal, and the cables 2 supported by the rollers 8 is oblique, it is impossible for a maintenance operator standing on the gangway 6 to work at a constant height.

Consequently, there is a need for adapting the slope of the gangway 6 to the slope of the cable 2. To meet this need, the vehicle comprises a guiding rod 11 fixed to the gangway 6 by one of its ends. The other end of the guiding rod 11, opposite the end fixed to the gangway 6, is connected to the cable 2. Preferably, the guiding rod 11 is connected to the cable 2 by an associated fastener, preferably in a fixed or disengageable way. The gangway 6 is pivotingly mounted on the suspending rod 5 so as to form an articulated bascule. Thus, by means of the guiding rod 11, the gangway 6 will be directed according to the slope of the cable 2, which will reduce the future risks to hit the cable 2 where there is a change in slope of the cable 2, and will allow an easier access to the rollers 8 of the pylon 3 (FIG. 6). This can be made possible thanks to the use of a pivoting axis of the gangway perpendicular to the direction of displacement of the maintenance vehicle 1.

The gangway 6 is preferably arranged between the gondola 4 and the fastener 9.

Figure 2:
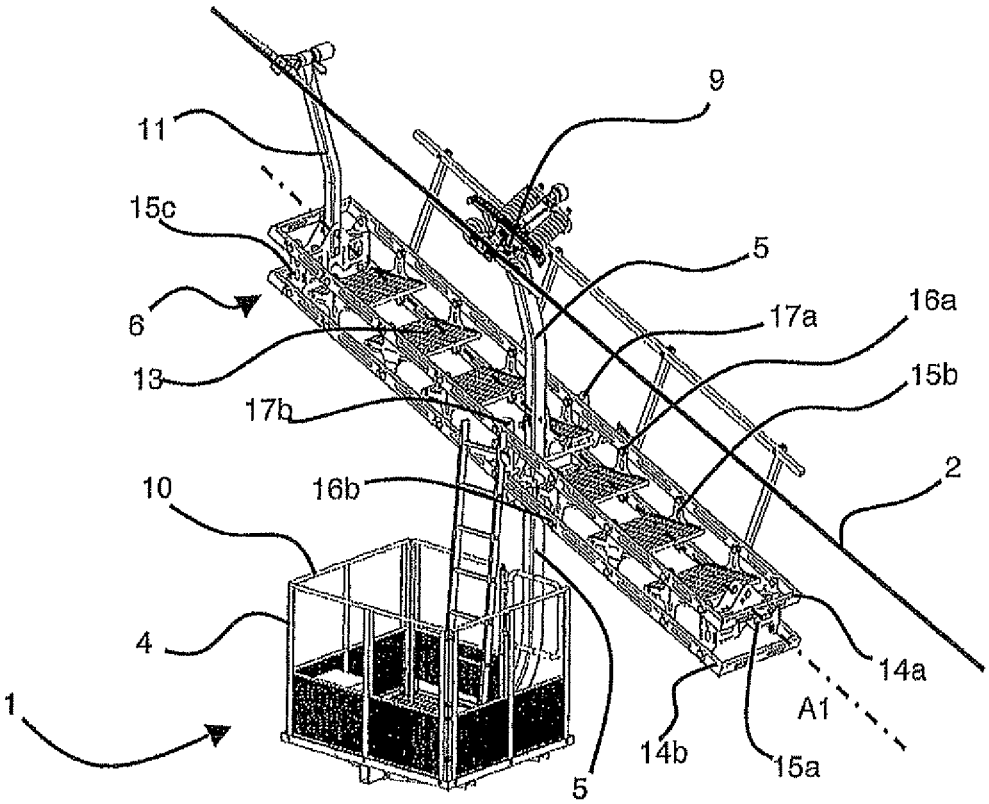
FIG. 2 illustrates a perspective view of a maintenance vehicle whose gangway is in an oblique position.
Figure 3:
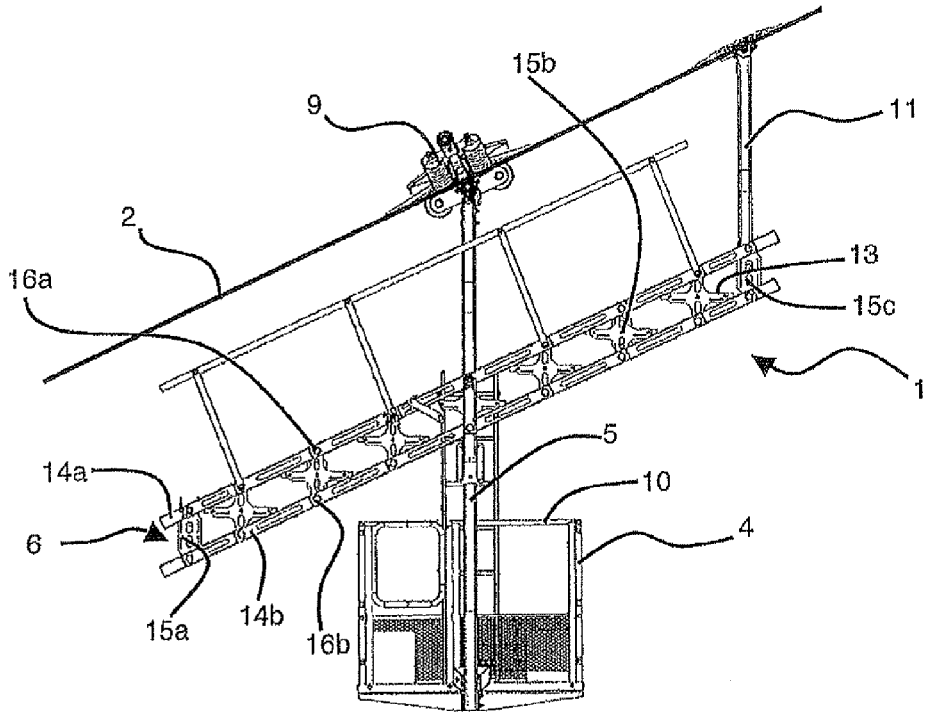
FIG. 3 illustrates a side view of the vehicle in FIG. 2, said view being in a vertical plane substantially parallel to the direction of displacement of the vehicle.

FIGS. 2 and 3 illustrate the maintenance vehicle 1 coupled with a cable 2 having an oblique slope. The gangway 6 is substantially parallel to the cable 2 thanks to the guiding rod which preferably allows to keep the gangway 6 at the same distance from the cable 2.

Figure 4:
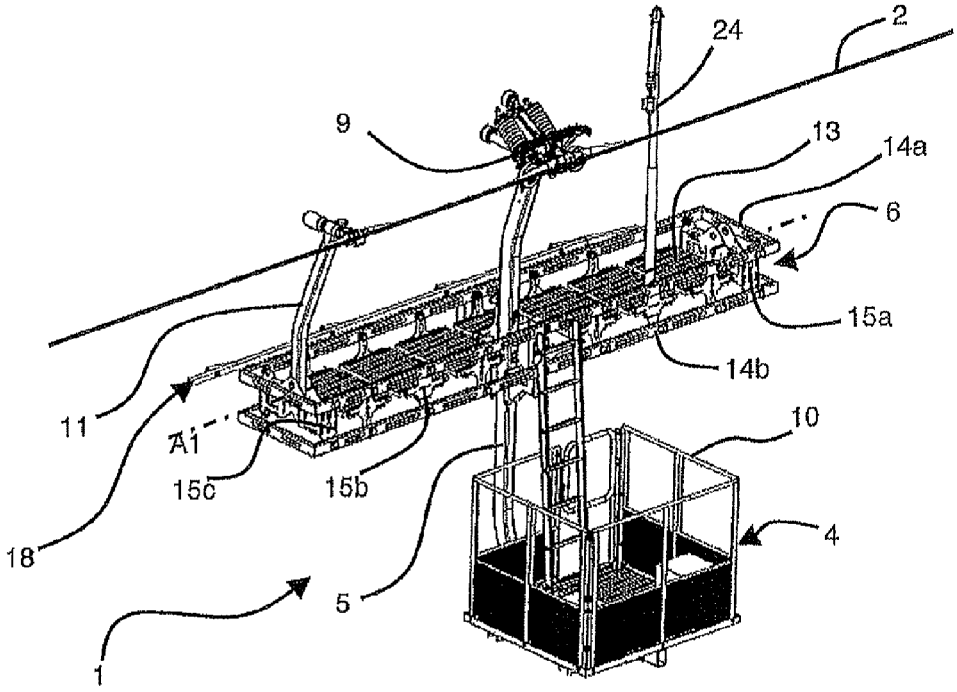
FIG. 4 illustrates a perspective view of a maintenance vehicle whose gangway is in a horizontal position.
Figure 5:
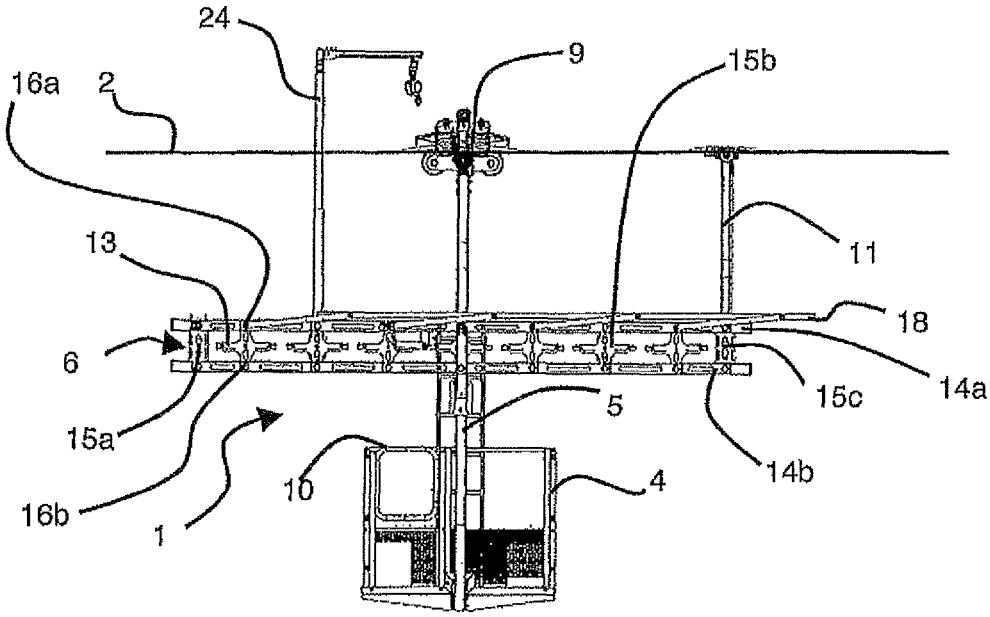
FIG. 5 illustrates a side view of the vehicle in FIG. 4, said view being in a vertical plane substantially parallel to the direction of displacement of the vehicle.

FIGS. 4 and 5 illustrate the gangway 6 in a horizontal position, i.e. substantially parallel to the gondola 4 and the cable 2.

In this text, under 'horizontal', it is preferably understood a plane perpendicular to the vertical, the vertical being parallel to the direction of the earth, gravity given for example by a plumb line.

FIG. 6 enables to visualize the position of the gangway 6 at a pylon 3. This FIG. 6 clearly shows that the elongated structure, oriented parallel to the cable 2, allows the maintenance operator 12 to reach the various rollers 8 of the pylon 3 while moving along the gangway 6 according to its longitudinal axis A1.

According to an improvement enabling to facilitate the work of the maintenance operator 12 and to ensure his/her safety, the gangway 6 comprises steps 13 arranged to remain horizontal whatever the pivoting angle of the gangway 6 relative to the horizontal. As illustrated in FIGS. 2 and 6, these steps 13 are shifted along the longitudinal axis A1 of the gangway 6.

In FIGS. 4 and 5, the gangway 6 is horizontal and the steps 13 are aligned in the same plane parallel to the horizontal, whereas in FIGS. 2 and 3 the gangway 6 is oblique and the steps 13 form a staircase going from the lower end to the upper end of the gangway 6.

According to a variant of implementation illustrated in FIGS. 2 to 6, the gangway 6 comprises two frames 14*a*, 14*b* elongated in the direction of displacement of the vehicle 1. The elongated frames 14*a*, 14*b* are pivotingly mounted on the suspending rod 5 respectively according to two parallel pivoting axes shifted along the suspending rod 5 in order to form a deformable parallelogram according to the pivoting angle of the gangway 6 relative to the suspending rod 5. A frame 14*a*, 14*b* comprises in the same plane two longitudinal struts oriented according to the axis A1 of the gangway 6, these two longitudinal struts are connected together at their proximal ends by means of transverse struts. Preferably, the longitudinal struts are perpendicular to the transverse struts. The frames 14*a*, 14*b* are preferably located in two parallel planes. The parallelogram shape is given in particular by a section of the gangway 6 according to a plane perpendicular to the plane formed by a frame and parallel to the axis A1, i.e. to the direction of displacement of the maintenance vehicle. 1 Thus, in FIG. 5, the gangway 6 has a general rectangular shape, and in FIG. 3 the gangway 6 has another parallelogram shape. This parallelogram shape enables the use of several steps 13 able to remain horizontal whatever the slope of the gangway 6.

According to a particular implementation notably shown in FIGS. 2 to 6, the gangway 6 comprises spacers 15*a*, 15*b*, 15*c*. Each spacer 15*a*, 15*b*, 15*c* includes a first end 16*a* pivotingly mounted on two opposite longitudinal struts of one of the frames 14*a* and a second end 16*b* pivotingly mounted on two opposite longitudinal struts of the other frame 14*b*. These spacers allow the frames 14*a*, 14*b* to always form a parallelogram whatever the degree of slope of the gangway 6 while maintaining said frames 14*a*, 14*b* parallel. Preferably, for each spacer 15*a*, 15*b*, 15*c*, a plane passing through the pivoting axis of its first end and through the pivoting axis of its second end is parallel to the vertical.

The spacers 15*a*, 15*b*, 15*c* can comprise two end spacers 15*a*, 15*c*, each of them being arranged at a longitudinal end of the gangway 6, and intermediate spacers 15*b*, each of them being provided with a plate for forming a step 13. The plate is preferably perpendicular to the plane including the pivoting axis of the first end and the second end of the intermediate spacer 15*b*. The guiding rod 11 is preferably fixed to one of the end spacers 15*a*, 15*c*. In FIGS. 2 to 6, the guiding rod 11 is fixed to the end spacer 15*c*.

Figure 7:
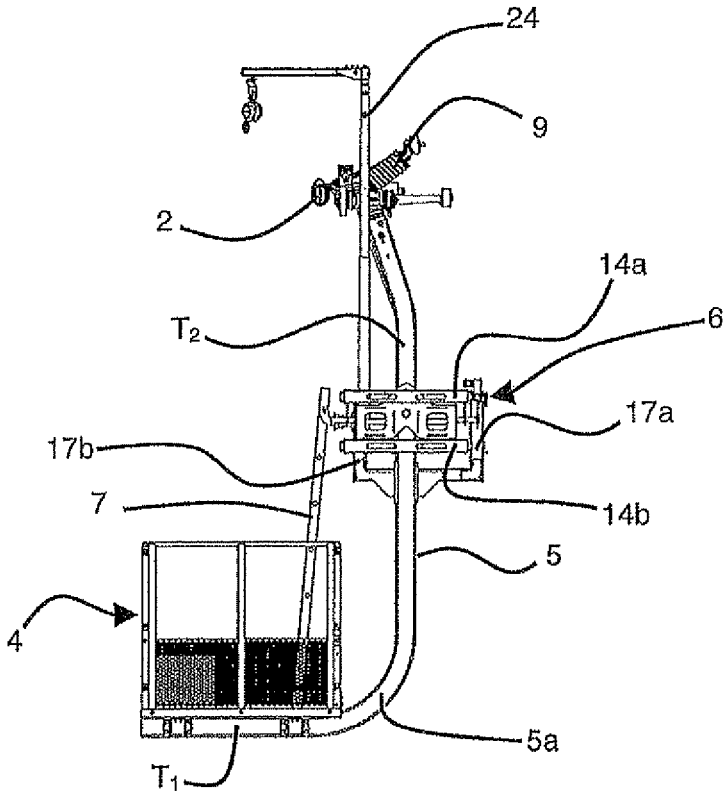
FIG. 7 illustrates a view of the maintenance vehicle perpendicular to the direction of displacement of said vehicle.

According to an implementation, the suspending rod 5 comprises a main rod extending through both frames 14*a*, 14*b*. In other words, the main rod is secant to the planes formed by the frames 14*a*, 14*b* and extends between both longitudinal and transverse struts of each frame. As illustrated in FIGS. 2 and 7, two fasteners 17*a*, 17*b* are fixed on both sides of the main rod, each fastener 17*a*, 17*b* cooperating, by means of associated pivot connections, with a longitudinal strut of each frame (14*a*, 14*b*).

Figure 8:
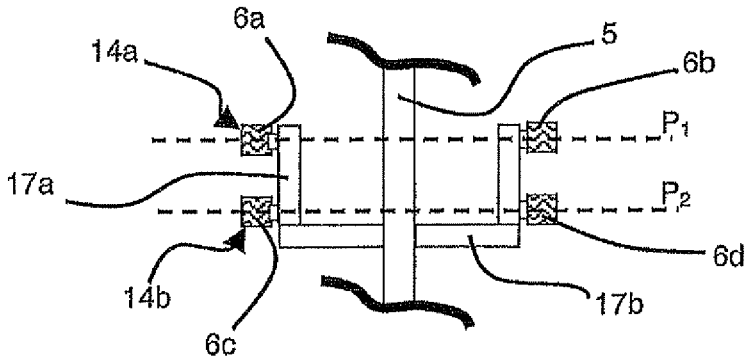
FIG. 8 illustrates a cross-section perpendicular to the direction of displacement of the maintenance vehicle schematically representing how the gangway is pivotingly mounted to the suspending rod.

FIG. 8 enables to illustrate in more detail how the gangway is pivotingly mounted on the suspending rod 5 by the use of fasteners 17*a*, 17*b*. In fact, the upper strut 14*a* is mounted on the one hand by a pivot connection on the fastener 17*a* at its first longitudinal strut 6*a* and on the other hand by a pivot connection on the fastener 17*b* at its second longitudinal strut 6*b* opposite the first longitudinal strut 6*a*, these two pivot connections comprise the same pivoting axis $P_1$. In the same manner, the lower frame 14*b* is mounted on the one hand by a pivot connection on the fastener 17*a* at its first longitudinal strut 6*c*, and on the other hand by a pivot connection on the fastener 17*b* at its second longitudinal strut 6*d* opposite the first longitudinal strut 6*c*, these two pivot connections comprise the same pivoting axis $P_2$. Preferably, the pivoting axis $P_1$ and $P_2$ are parallel and delimit a vertical plane.

As illustrated in FIG. 7, a portion 5*a* of the suspending rod 5 preferably has an arched shape enabling to delimit a first section $T_1$ for supporting the gondola 4. Preferably, the section $T_1$ is horizontal and perpendicular to the direction of displacement of the maintenance vehicle. This portion 5*a* also enables to delimit a second section $T_2$ connecting the first section $T_1$ to the fastener 9. Preferably, the second section $T_2$ is substantially vertical. The gangway 6 is mounted on the suspending rod 5 at the second section $T_2$. In other words, in a general way, the gangway 6 is located on the suspending rod 5 between the gondola 4 and the fastener 9. Consequently, it is possible to provide passage means for passing from the gondola 4 to the gangway 6, these passage means can be carried out as a ladder 7.

Preferably, the gangway 6 is not located under the cable 2 but is shifted from the cable 2 relative to the vertical so as to facilitate the access to the rollers 8 of a pylon 3 on which the cable 2 will be supported. Thus, in FIG. 6, the maintenance vehicle 1 can be coupled with the cable 2 so that the gangway 6 is distal from the pylon 3 supporting the cable 2. If considering a vertical plane passing through the cable 2 parallel to said cable 2, the pylon 3 is located on the left of said vertical plane, and the gangway 6 is located on the right of said vertical plane. According to FIG. 6, starting from the pylon 3, one finds in a shifted way in the same direction the gondola 4 and then the gangway 6.

In order to improve the security of the maintenance operator 12 illustrated in FIG. 6, the gangway 6 comprises a railing 18, preferably a retractable one. Such a railing 18 can then be in an outspread state forming a guardrail as in FIG. 6, and in a storage state in which the railing 18 is retracted in the direction of a platform of the gangway 6 as illustrated in FIGS. 4 and 5. Under 'platform', it is understood the structure of the gangway where the operator can walk. This railing 18 is preferably mounted along the gangway on its longitudinal side opposite the gondola 4, i.e. the distal side of the gangway 6 distal from the pylon 3 in FIG. 6.

Preferably, the maintenance vehicle comprises control means enabling to go from the outspread state into a retracted state of the railing 18 and conversely. These control means are accessible from the gondola 4. Thus, before going up onto the gangway 6, the maintenance operator can outspread the railing 18.

Figure 9:
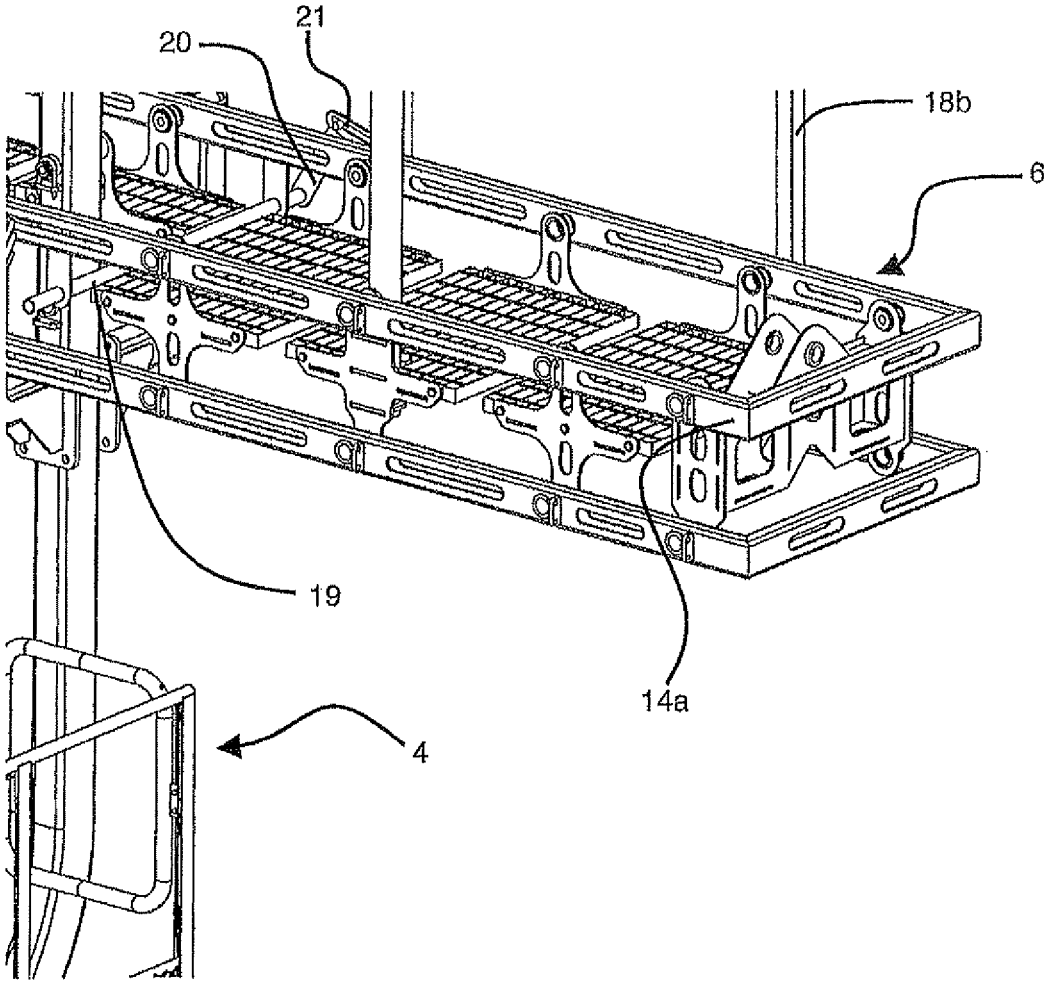
FIG. 9 illustrates a view of the maintenance vehicle focused on the control means enabling to outspread the railing of the gangway.
Figure 10:
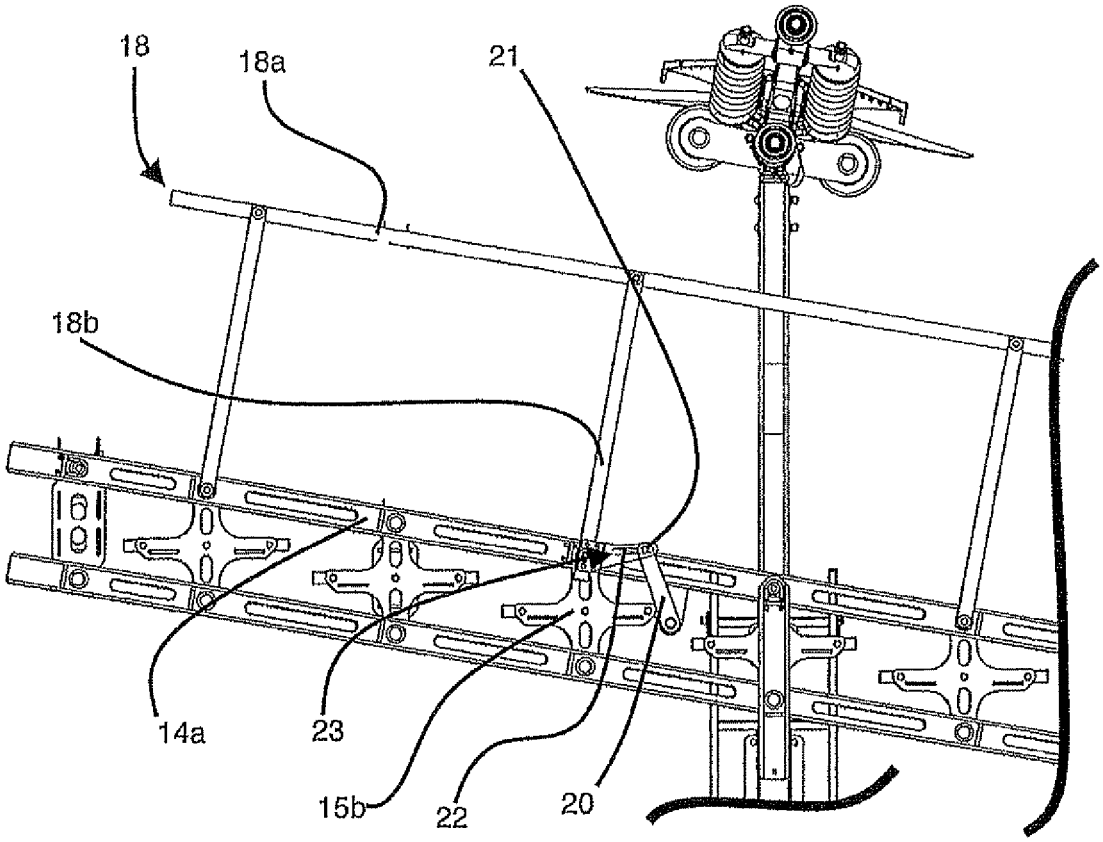
FIG. 10 illustrates another view of the maintenance vehicle focused on the control means enabling to outspread the railing.

In FIGS. 9 and 10 the railing 18 can comprise a handrail 18*a* (FIG. 10) and struts 18*b* integral on the one hand with the handrail and on the other hand with a frame 14*a* of the gangway. Each strut 18*b* is connected on the one hand to the frame 14*a* by means of a pivot connection, and on the other hand to the handrail lea by means of a pivot connection.

The control means can be implemented by a cylindrical rod 19 extending laterally through the gangway 6. The cylindrical rod 19 comprises an actionable end of the gondola 4 so as to rotate the cylindrical rod 19, and comprises at its end opposite the gondola 4 a body 20 fixed to the rod 19, and extending perpendicular to the cylindrical rod 19. This body 20 comprises a pin 21 at its end distal from the rod 19. The pin 21 slides in a lumen 22 in a return arm 23 fixed to one of the struts 18*b* of the railing. The return arm 23 is arranged so that the rotation of the cylindrical rod 19 causes a movement of the pin 21 which moves in the lumen 22 in the return arm 23 while transmitting to the return arm 23 a movement causing the outspread of the railing 18 when the latter is in the retracted position, or the storing of the railing 18 when the latter is in the outspread position.

FIG. 10 shows that the struts 18*b* take advantage of the pivoting axes of the end of the intermediate spacers 15*b* so that they can be pivotingly mounted there. This allows inter alia to avoid the duplication of the pivoting axes at the frame 14*a* in order to reduce the weight of the maintenance vehicle.

Of course, the man skilled in the art is able to implement any kind of railing able to be outspread and retracted with the help of remote control means.

Preferably, the distance between the gangway steps and the cable are adjusted so that the cable is on the level of the maintenance operator when he/she is on the gangway.

The gangway 6 can moreover comprise tools. In FIGS. 4 to 7 the tools comprise a mast 24 provided with a pulley. Of course, the man skilled in the art will be able to add any kind of tools useful for the maintenance of the rollers of a pylon.

As in the prior art, the installation can be of any type. Preferably, between an station before and a station after the installation, the vehicle is fixed to the cable 2 which is a hauling cable.

The invention claimed is:

1. A transport installation with an aerial cable for moving along a path, comprising:

a maintenance vehicle which comprises a gondola mounted on a suspending rod connected to the cable by a fastener, a gangway mounted on the suspending rod, and a guiding rod fixed to the gangway at one of its ends, and connected to the cable at its opposite end, wherein the guiding rod maintains the gangway at substantially the same distance from the cable, and the gangway has a structure extending in a direction of displacement of the maintenance vehicle, and is pivotingly mounted on the suspending rod so as to form an articulated bascule around a pivoting axis which is perpendicular to the direction of displacement.

2. The transport installation according to claim 1, wherein the gangway comprises steps arranged to remain horizontal whatever the pivoting angle of the gangway relative to the horizontal.

3. The transport installation according to claim 2, wherein the gangway comprises two frames elongated in the direction of displacement of the maintenance vehicle, the elongated frames being pivotingly mounted on the suspending rod respectively according to two parallel pivoting axes shifted along the suspending rod, the frames being arranged to form a deformable parallelogram according to the pivoting angle of the gangway relative to the suspending rod.

4. The transport installation according to claim 3, wherein that the gangway comprises spacers, each spacer including a first end pivotingly mounted on two opposite longitudinal struts of one of the frames and a second end pivotingly mounted on two opposite longitudinal struts of the other frames.

5. The transport installation according to claim 4, wherein the spacers comprise two end spacers, each end spacers being arranged at a longitudinal end of the gangway, and intermediate spacers, each intermediate spacer comprising a plate for forming a step, the guiding rod being fixed to one of the end spacers.

6. The transport installation according to claim 3, wherein the suspending rod comprises a main rod extending through both frames, two fasteners being fixed on both sides of the main rod, each fastener cooperating, by means of associated pivot connections, with a longitudinal strut of each frame.

7. The transport installation according to claim 1, wherein the gangway comprises a railing, the railing is configured to be alterable from an outspread state forming the railing, and a storage state, and in the storage state, the railing is retracted in a direction so as to be substantially in line with a platform of the gangway.

* * * * *